United States Patent [19]

Contarino

[11] 4,255,638

[45] Mar. 10, 1981

[54] MINIATURE SWITCH, SEALED FOR SOLDERING, WITH HANDLE HOUSING EXPOSED

[75] Inventor: Alfred F. Contarino, Andover, Mass.

[73] Assignee: Alco Electronic Products, Inc., North Andover, Mass.

[21] Appl. No.: 30,020

[22] Filed: Apr. 13, 1979

[51] Int. Cl.[3] ..... H01H 9/04

[52] U.S. Cl. ..... 200/302

[58] Field of Search ..... 200/302

[56] References Cited

U.S. PATENT DOCUMENTS

| | | | |
|---|---|---|---|
| 2,740,872 | 4/1956 | Brodsky et al. | 200/302 |
| 2,814,703 | 11/1957 | Martin | 200/302 |
| 2,814,704 | 11/1957 | Balo | 200/302 |

*Primary Examiner*—Willis Little

*Attorney, Agent, or Firm*—Pearson & Pearson

[57] ABSTRACT

A miniature switch, having a projecting handle housing, is provided with a factory installed environmental sealed cover which stops solder, flux and cleaning solvents before they enter the contact cavity within the switch. The switch case is enclosed in a second case of plastic with a hardened layer of epoxy in the space between cases and across the open bottom of the second case to substantially encapsulate the switch. An annular bead of hardened epoxy seals the exposed, projecting, handle housing at its base in its aperture in the second case to complete the seal.

6 Claims, 2 Drawing Figures

MINIATURE SWITCH, SEALED FOR SOLDERING, WITH HANDLE HOUSING EXPOSED

BACKGROUND OF THE INVENTION

The conventional miniature toggle switch has included a plastic case of cubical configuration and a metal frame affixed to the case by inturned integral metal tabs. The frame has included an exteriorly threaded toggle handle housing projecting upwardly and a plurality of conductive metal terminals extending downwardly through suitable holes in the bottom of the plastic cases. There are usually integral plastic legs, depending from each corner of the plastic case, to rest on a printed circuit board for positioning purposes.

It has been found that in the processing of printed circuitry, attachment of components by soldering, cleaning of the resulting product etc. that solder, flux or cleaning solvents sometimes may enter the interior contact cavity of the switch through the spaces around the handle housing, the space between frame and case or the space between terminal and terminal hole. In such case, high contact resistance, intermittent operation or shortened life expectancy may result.

SUMMARY OF THE INVENTION

In this invention the toggle switch case and frame are enclosed in a second case, having a top aperture for the toggle housing of the switch and having an open bottom for receiving the switch. A sufficient clearance is provided between the side walls of the switch and the side walls of the second case so that a layer of epoxy may fill the clearance and form a bottom closure layer embedding the bases of the terminals and encapsulating the switch. An annular bead of epoxy is applied around the base of the toggle housing between it and the inside surface of the top wall aperture thereby sealing the same also.

In the method of the invention, the case is made slightly larger than the switch, the bead of epoxy is applied around the rim of the top wall aperture, the switch is then inserted, toggle housing first, into the dual case to seat against the bead of epoxy with a uniform clearance between side walls of the cases. Epoxy is then injected into the clearance, preferably by hypodermic needle to fill up the clearance and form a closure layer on the switch bottom around the base of the terminals, the epoxy is then cured to form the seal and encapsulation.

DESCRIPTION OF THE PREFERRED EMBODIMENT

Figure 1:
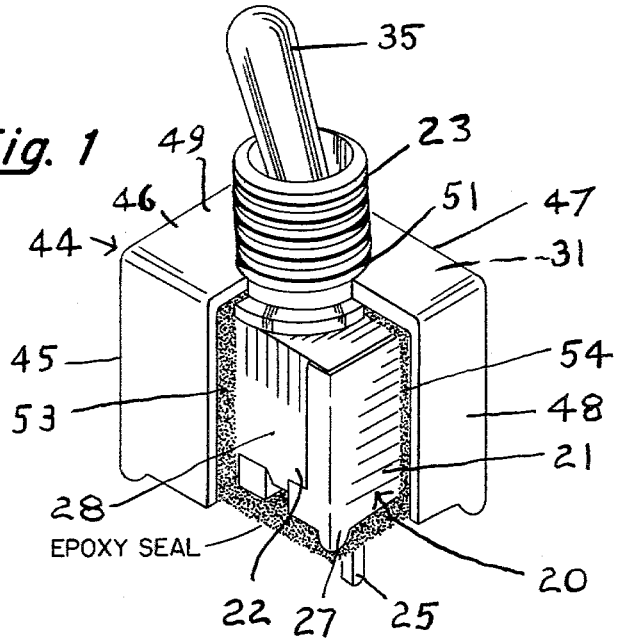
FIG. 1 is a perspective view of an environmentally sealed miniature toggle switch of the invention, with parts broken away.
Figure 2:
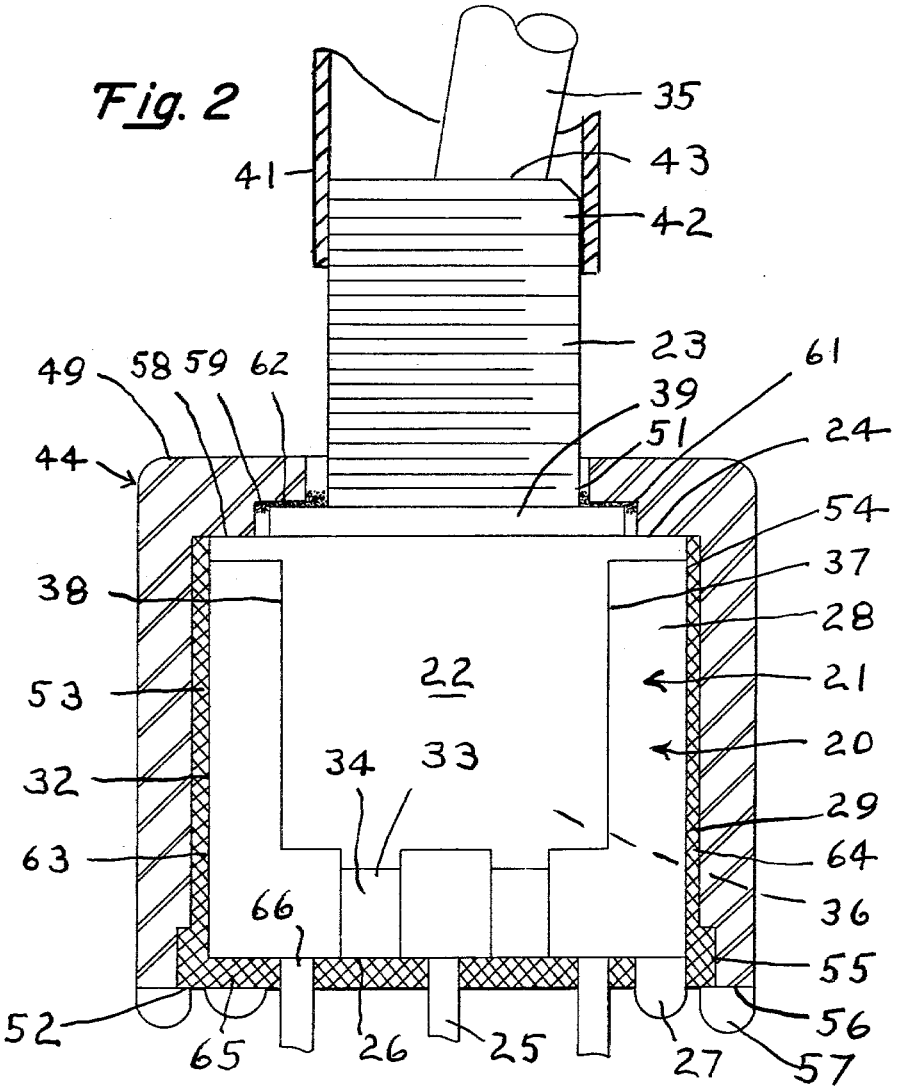
FIG. 2 is a side elevation on an enlarged scale, of the switch shown in FIG. 1 in section on line 2—2 of FIG. 1.

In the drawing a conventional miniature toggle switch 20 includes a case 21, usually of plastic, a frame 22, usually of metal, the frame having a toggle handle housing 23 of cylinderical, threaded configuration extending upwardly from the top 24 and having a pluarlity of conductive terminals 25 extending downwardly from the bottom 26 thereof. The case 21 usually includes four legs such as at 27, one in each corner to position the switch on a printed circuit board. The four side walls of switch 20 are designated 28, 29, 31 and 32 and it should be noted that the metal frame 22, of inverted U shape, is attached by inturned integral metal tabs 33 each in a recess 34 in the U shaped plastic case 21. The toggle handle 35 actuates the switch arms in the switch contact area 36 within the switch 20.

It will be seen that regardless of how accurately and precisely the frame and case are made in miniature size, when a switch 20 is mounted on a printed circuit board and processing with solder, flux or cleaning solvents take place, there is a possibility that such materials can enter, for example, the cracks or joints 37 or 38 between frame and case thereby causing high contact resistance, intermittent operation or shortened life expectency of the delicate miniature parts in the contact area 36 of switch 20. The base of the toggle handle housing is designated 39.

In this invention, to seal the miniature toggle switch 20 against any possibility of damage by the entrance of unwanted materials into the interior of the switch, a flexible, splash-proof, toggle boot 41, preferably of neoprene, and preferably disposable, is slipped over the toggle handle 35 and over the upper portion 42 of the toggle handle housing 23 to temporarily seal the open upper end 43 of the housing. The spherical portion of toggle handle 35 is usually sealed in place by suitable O rings but the boot 41 is added insurance that no solder, flux, or solvents may enter the housing and thence enter the contact area 36 of switch 20.

To seal the case 21 of switch 20, an outer case 44, of plastic or other suitable material, and having four side walls 45, 46, 47 and 48, a top wall 49 with a toggle handle housing aperture 51 and an open bottom 52 is provided. The side walls 45, 46, 47 and 48 are of predetermined dimensions to receive the switch 20, toggle housing first, through open bottom 52 with a loose fit to form a predetermined clearance of uniform width, away from the corresponding side walls 28, 29, 31 and 32 of the case 21 of switch 20, as indicated at 53 and 54.

A groove 55 of increased dimensions extends around the inside of the rim 56 of the open end, or open bottom 52 of the outer case 44 and case 44 includes integral corner legs such as at 57 as shown.

The upper, or top wall 24 of inner case 21 engages shoulders 58 in the inside face of the top wall 49 of the outer case 44 so that there is a predetermined clearance 59 between the base 39 of toggle housing 23 and the groove 61 in the inner surface of the aperture 51 in top wall 49 of outer case 44, the clearance space being annular and of uniform width.

In operation, for sealing the inner case, an annular bead 62 of small dimensions (approximately 0.020 diameter) of epoxy is applied around the bushing flange 39 and in the groove 61 whereupon the inner case 21 is inserted, toggle handle first into outer case 44 until the switch case is fully and firmly seated and properly positioned with a clearance 53, or 54, of uniform width between all four adjacent side walls of the cases.

The assembly is then warmed to approximately 125° C. for about five minutes and the clearances 53, 54 between the side walls filled with epoxy up to the rim, or edge, 56 of the case 44. The epoxy not only fills the clearance spaces 53 and 54 with a layer 63 or 64 thereof but also forms a layer 65 resting on the bottom 26 of the inner case 21, embedding the bases 66 of the terminals 25 and forming a sealed closure across the open bottom 52 of outer case 44.

The assembly is then cured at 125° C. for fifteen minutes to produce a sealed, minature toggle switch in which the inner switch is substantially encapsulated in hardened epoxy. The resulting sealed switch is still substantially as small as an ordinary miniature switch, while being impervious to solder, flux and cleaning solvents. Such switches, sealed for flow soldering are thus a solution to the automated soldering and cleaning of miniature switches on printed circuit boards.

Preferably, the step of the method of this invention of injecting epoxy into the extremely small clearances between side walls of the inner and outer cases is performed by means of a hypodermic needle and syringe.

The preferred material for the inside case 21 is diallyl phthalate 94 V O, the preferred material for the outer case 44 is black polyester and the preferred epoxy for the layers 63, 64 or 65 is a filled, one component, fast curing epoxy adhesive and potting compound commercially available as UNISET A 304-9 while the preferred epoxy for the bead 62 is a fast curing, thixotropic epoxy commercially available as UNISET A329-6, both from Amicon Crop., Polymer Products Division, 25 Hartwell Avenue, Lexington, Mass. 02173.

It will be understood that while a typical miniature toggle switch is illustrated in the drawing, other types of miniature switches, having handle housings projecting therefrom, such as push botton switches or rocker switches may also be constructed in accordance with the invention. Thus a threaded handle housing, such as illustrated, may continue to be used for mounting the switch rather than being enclosed in a permanent flexible cover as taught in the prior art.

I claim:

1. A miniature toggle switch sealed for flow soldering, said switch comprising;

an outer case having four side walls, a top wall with an aperture therein and an open bottom, said case defining an enclosure;

an inner switch case and frame mounted within said enclosure and having four side walls, said walls having a predetermined clearance space of substantially uniform width, from the corresponding side walls of said outer case;

said inner switch case and frame having a toggle handle housing, for a toggle handle, projecting through said aperture in said top wall and having a bottom with a plurality of conductive terminals thereon projecting from said open bottom of said outer case, said toggle handle housing having a base portion within the aperture of said apertured top wall and spaced at a predetermined clearance of substantially uniform width therefrom, an annular bead of sealing material extending around, and in intimate contact with said base portion within said aperture and filling said clearance to seal the top wall of said outer case a layer of sealing material entirely filling the clearance space between the side walls of said outer case and side walls of said inner case and frame and a layer of said sealing material entirely convering the bottom of said inner switch case and frame whereby said inner case and frame is substantially encapsulated to seal the same against solder, flux, and cleaning solvents and said toggle handle housing and toggle handle are exposed for normal use;

a groove of increased dimensions extending around the inside of the rim of the open bottom of said outer case, said groove being entirely filled with said sealing material to further assure sealing of said switch.

2. A miniature toggle switch as specified in claim 1 wherein;

said handle housing is exteriorly threaded and said outer case includes a leg in each corner.

3. A miniature toggle switch as specified in claim 1 wherein;

said top wall includes a groove in the inner surface thereof extending around said aperture and an annular shoulder for seating said inner switch case.

4. A miniature switch sealed for flow soldering said switch comprising;

a miniature switch having four side walls, a top with a switch handle housing and handle projecting therefrom and a bottom with a plurality of conductive terminals projecting therefrom an outer case forming an enclosure receiving said switch, said outer case having a top wall with an aperture receiving said handle housing, an open bottom through which said terminals project and four side walls at a predetermined uniform clearance from the side walls of said switch, an annular bead of hardened epoxy extending around the outside of the base of said handle housing and in intimate contact with the surface of said aperture to seal the same against entrance of solder, flux or cleaning solvents into the contact area of said switch and a hardened layer of epoxy entirely filling the clearance between said side walls, entirely filling the bottom opening of said outer case and embedding the bases of said terminals therein to seal said outer case against entrance of solder, flux or cleaning solvents into the contact area of said switch said switch being sealed for flow soldering but said switch handle and switch handle housing being exposed to perform its normal function;

a groove of increased dimensions extending around the inside of the rim of the open bottom of said outer case, said groove being entirely filled with said sealing material to further assure sealing of said switch.

5. The method of sealing the case of a miniature switch against entrance of solder, flux or cleaning solvents into the contact area within said case said switch having a handle housing projecting therefrom which comprises the steps of providing a second case, of similar configuration to said switch case, and having a top wall with an aperture for the handle housing of said switch and having an open bottom for receiving said switch, the inner dimensions of said second case being slightly larger than the corresponding outer dimensions of said switch to create a clearance space therebetween;

then applying a small bead of epoxy around the inside of said handle housing aperture and on the corresponding portion of the handle housing of said switch then inserting said switch, handle housing first, through the open bottom of said second case fully seating it therewithin in contact with said epoxy bead with a uniform predetermined clearance space entirely therearound and with said handle housing projecting from said aperture then warming the assembly to approximately 125° C. for about five minutes then injecting epoxy into said clearance space between said switch and second case entirely filling the same until a sealing layer has been formed across the open bottom of said second case and then curing said epoxy at about 125° C. for about fifteen minutes.

6. A method as specified in claim 5 plus the step of:

temporarily affixing a disposable, flexible, splash-proof, boot over the exposed portion of said handle housing during the steps of applying and curing said epoxy and then removing said boot when said curing is completed.

* * * * *